United States Patent [19]

Rossi et al.

[11] Patent Number: 4,839,074

[45] Date of Patent: Jun. 13, 1989

[54] SPECIFIED $C_{14}$-CARBOXYLATE/VINYL ESTER POLYMER-CONTAINING COMPOSITIONS FOR LUBRICATING OIL FLOW IMPROVEMENT

[75] Inventors: Albert Rossi, Warren, N.J.; Robert Tack, Oxford; Kenneth Lewtas, Wantage, both of United Kingdom; Jose Alves, Rio de Janeiro, Brazil

[73] Assignee: Exxon Chemical Patents Inc., Linden, N.J.

[21] Appl. No.: 53,698

[22] Filed: May 22, 1987

[51] Int. Cl.[4] ..... C10M 129/26; C10M 129/68

[52] U.S. Cl. ..... 252/56 D; 252/56 R; 44/62; 44/70

[58] Field of Search ..... 44/62, 70; 252/56 D, 252/56 R, 59

[56] References Cited

U.S. PATENT DOCUMENTS

| | | | |
|---|---|---|---|
| 2,618,602 | 11/1952 | Bartlett | 252/56 |
| 2,825,717 | 3/1958 | Cashman | 526/325 |
| 3,250,715 | 5/1966 | Wyman | 252/56 |
| 3,814,690 | 6/1974 | Song | 252/56 D |
| 4,058,371 | 11/1977 | Ilnyckyj | 44/70 |
| 4,088,589 | 5/1978 | Rossi et al. | 252/56 |
| 4,240,916 | 12/1980 | Rossi | 252/56 D |
| 4,284,414 | 8/1981 | Bryant | 252/56 D |
| 4,359,325 | 11/1982 | Dawans et al. | 252/56 D |
| 4,514,314 | 4/1985 | Rossi | 252/56 D |
| 4,519,932 | 5/1985 | Schnur et al. | 252/56 D |
| 4,632,769 | 12/1986 | Gutierrez et al. | 252/56 D |
| 4,661,121 | 4/1987 | Lewtas | 44/70 |
| 4,661,122 | 4/1987 | Lewtas | 44/70 |
| 4,663,491 | 5/1987 | Barthell et al. | 252/56 D |
| 4,713,088 | 12/1987 | Tack et al. | 44/62 |

FOREIGN PATENT DOCUMENTS 2023645 10/1982 United Kingdom .

OTHER PUBLICATIONS

Ser. No. 703,339, Tack et al.
Ser. No. 703,340, Tack et al.
Ser. No. 944,545, Detraker et al.

*Primary Examiner*—William R. Dixon, Jr.
*Assistant Examiner*—Margaret B. Medley
*Attorney, Agent, or Firm*—R. A. Maggio

[57] ABSTRACT

Compositions are disclosed for improving at least the low temperature flow properties of lubricating oils. The compositions are dual additives including a first component which is a polymer or interpolymer of a $C_{14}$ carboxylate, such as a $C_{14}$-dialkyl fumarate/vinyl acetate interpolymer, and a second component which is a lubricating oil flow improver comprising a non-ethylene containing polymer or interpolymer such as dialkyl fumarate/vinyl acetate interpolymer, esterified styrene/maleic anhydride interpolymer, or esterified olefin/-maleic anhydride interpolymer.

84 Claims, No Drawings

SPECIFIED $C_{14}$-CARBOXYLATE/VINYL ESTER POLYMER-CONTAINING COMPOSITIONS FOR LUBRICATING OIL FLOW IMPROVEMENT

FIELD OF THE INVENTION

The present invention relates to additives for improving the flow properties of certain oleaginous compositions. More particularly, the present invention relates to additives for improving at least the low temperature flow properties of lubricating oil compositions, and more particularly the lubricating oil compositions which include lubricating oil flow improvers. Still more particularly, the present invention relates to improved lubricating oil compositions including such additives for improving the flow properties thereof. More particularly, the present invention relates to methods for improving the flow properties of oleaginous compositions, particularly engine crankcase lubricant compositions.

BACKGROUND OF THE INVENTION

A wide variety of compounds for use as lubricating oil or fuel oil additives are known in this art. These include compounds variously referred to as pour point depressants, viscosity index improving compositions, wax crystal modifiers, and the like. In particular, Cashman et al, U.S. Pat. No. 2,825,717, discloses the preparation of certain lubricating oil additives by the copolymerization of polycarboxylic acid esters with other polymerizable monomeric materials, including vinyl compounds such as vinyl acetate. The preferred unsaturated polycarboxylic acid esters therein are fumaric acid esters produced from $C_1$ through $C_{18}$ aliphatic alcohols.

Bartlett, U.S. Pat. No. 2,618,602, discloses pour point depressing and/or viscosity index improving materials obtained by polymerizing certain specified alkyl fumarate esters. In particular this patentee discloses the use of polymerized fumarate esters of $C_{12}$ to $C_{14}$ alcohols for such purposes. This patent specifically discloses that the $C_{12}$ alcohol was more effective than the $C_{14}$ alcohol, although both polymerized esters exhibited pour point depressing properties.

Rossi et al, U.S. Pat. No. 4,088,589, discloses the use of specified mixtures of lubricating oil pour point depressants which include polyesters consisting of a polymeric ester of acrylic acid or methacrylic acid and a monohydric alcohol containing from 10 to 18 carbon atoms, and/or interpolymers of a vinyl alcohol ester of a $C_2$ to $C_{18}$ alkanoic acid (e.g., vinyl acetate) and a di($C_6$–$C_{18}$alkyl) fumarate as one of the components thereof for improving the viscosity index of high wax content lubricating oils which also include viscosity index improving ethylene copolymers. Also, Wyman, U.S. Pat. No. 3,250,715, discloses terpolymers of dialkyl fumarates, vinyl esters, and alkyl vinyl ethers for improving the pour point of lubricating oils, and most particularly in which the dialkyl fumarates are prepared from various $C_{10}$ through $C_{18}$ alcohols including tetradecyl alcohol alone as well as alcohol mixtures averaging from 12 to 14 carbon atoms.

There has also been disclosed in co-pending U.S. patent applications Ser. Nos. 703,339 and 703,340, both of which were filed on Feb. 20, 1985, the use in various middle distillate fuel compositions for lowering the pour point and controlling the size of wax crystals in these products which specifically include polymers and copolymers of specific dialkyl fumarate vinyl acetate copolymers. Most specifically, these patent applications disclose the use of such compounds in which the average number of carbon atoms in the alkyl groups in the polymer or copolymer must be from 12 to 14. In addition these additives are also disclosed as being useful in combination with the polyoxyalkylene esters, ethers, esters/ethers and mixtures thereof, as well as with various other additives. Furthermore, British Pat. No. 2,023,645 discloses, for use in treating distillate fuel oils, various three-component systems which include as a first component flow improvers having an ethylene backbone, such as various ethylene polymers including ethylene polymerized with various mono- or diesters (e.g., vinyl acetate; and $C_{13}$ fumarates), as a second component a lube oil pour depressant such as various oil soluble esters and/or higher olefin polymers (e.g., dialkyl fumarate, vinyl acetate copolymers), and as a third component various polar oil-soluble compounds (e.g., phenates, sulfonates, phosphates, and carboxylates).

It is also disclosed in Lewtas' U.S. Pat. Nos. 4,661,121 and 4,661,122 that the size of wax crystals forming in fuels boiling in the range of 120° C. to 500° C. can be controlled by an additive which includes the polymers and copolymers of mono- and di-n-alkyl esters of monoethylenically unsaturated $C_4$ to $C_8$ mono- or dicarboxylic acids, in which the average number of carbon atoms in the n-alkyl groups is from 14 to 18. These patents show a preference for copolymers of di-n-alkyl fumarates and vinyl acetate, and specifically state that the fumarates can be made from single alcohols or mixtures of alcohols, and when mixtures are used they are mixed prior to esterification. Furthermore, these patents disclose the use of various ethylene unsaturated ester copolymer flow improvers as co-additives therewith, but do not specify that these additives are produced from alcohol mixtures. Finally, in co-pending U.S. Ser. No. 944,545, filed on Dec. 19, 1986, which is a Divisional of U.S. Ser. No. 589,536, filed on Mar. 14, 1984, there is disclosed as a dewaxing aid a copolymer of dialkyl fumarate and vinyl acetate in which a large porportion of the alkyl groups are $C_{20}$ to $C_{24}$ alkyl groups.

While these various types of additive compositions have met with various degrees of success in the particular environments in which they are employed, it has been observed that various lubricating oil compositions, such as those containing certain viscosity improving additives, such as copolymers of ethylene and propylene, as well as those lubricating oil compositions containing lubricating oil flow improvers, nevertheless experience difficulty in passing recently adopted, more stringent, low temperature, slow cool performance tests designed to measure the low temperature pumpability of crankcase lubricating oils. It is therefore an object of the present invention to provide additives which enhance the low temperature pumpability of lubricating oil compositions.

SUMMARY OF THE INVENTION

In accordance with the present invention, these and other objectives have now been realized by a dual component additive composition which significantly improves at least the low temperature flow properties of lubricating oils and which comprises, as a first component, low molecular weight ($\overline{M}_n$) polymers and interpolymers (e.g., copolymers) of unsaturated mono- or dicarboxy esters having the formula:

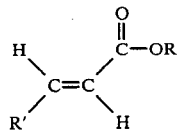

(I)

in which R′ is either hydrogen or a COOR radical, and in which R is a $C_{14}$ alkyl group, in admixture with at least one second component of a low molecular weight ($\overline{M}_n$) lubricating oil flow improver (LOFI) comprising non-ethylene containing polymers which are soluble or dispersible in these lubricating oils. Indeed, it has been discovered that this specific combination provides a synergistic improvement in at least the low temperature viscosity performance of these lubricating oil compositions in that the results demonstrated are superior to the additive effect obtained by using either of these components alone in such lubricating oil compositions. These highly unexpected results have now permitted the formulation of lubricating oil compositions, particularly those which contain olefinic copolymer viscosity modifying additives which exhibit enhanced slow cool, low temperature viscosity performance.

In a preferred embodiment of the dual additive compositions of the present invention, the first component thereof comprises a low molecular weight ($\overline{M}_n$) interpolymer of at least one of the carboxy ester monomers of formula (I) above with a polymerizable vinyl ester monomeric compound having the formula:

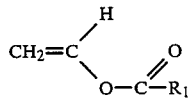

(II)

in which $R_1$ is an alkyl group containing from about 1 to 18 carbon atoms, preferably from about 1 to 6 carbon atoms, and most preferably 1 carbon atom. The preferred ester monomer of formula (II) is vinyl acetate.

In accordance with one embodiment of the dual additive compositions of the present invention, the second component lubricating oil flow improvers are one or more of those including (1) interpolymers of (a) unsaturated esterified dicarboxylic acids or anhydrides; and (b) vinyl esters, alpha-olefins or styrene; (2) poly-2-alkylacrylates; or (3) polyacrylates. In a particularly preferred embodiment the second component comprises interpolymers of dialkyl fumarates and vinyl esters, in which the fumarates are esterified with mixtures of $C_6$ through $C_{20}$ alcohols.

As noted above, in a preferred embodiment, the dual additive composition of the present invention is employed in combination with a viscosity index improving amount of a viscosity modifier including a copolymer of ethylene with a higher alpha-olefin, particularly one such as propylene.

In accordance with another embodiment of the present invention, lubricating oil compositions having improved flow properties are provided comprising the above-noted dual additive composition.

DETAILED DESCRIPTION

The additives of the present invention comprise a synergistic mixture of the specified first component polymers and interpolymers of unsaturated carboxy esters along with at least one second component lubricating oil flow improver. The critical first component of this mixture is a polymer or interpolymer of an acrylic acid ester having the formula:

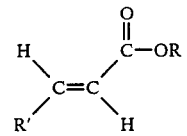

(I)

in which R′ is either hydrogen or the COOR radical, and in which R is a $C_{14}$ alkyl group. The production of these ester and diester polymers includes an esterification reaction between unsaturated mono- or dicarboxylic acids or their corresponding anhydrides, as well as the polymerization of the esterified monomers, and is well known in the art, as specifically disclosed beginning at column 2, line 35 of Cashman et al, U.S. Pat. No. 2,825,717, which disclosure is incorporated herewith by reference thereto.

The first component preferably includes the interpolymers of the diester monomers of formula (I), wherein R′ is COOR, with a monomer of formula (II), preferably vinyl acetate, in a reaction which is carried out in the presence of free radical initiators, such as a peroxide catalyst.

The first component is characterized by a low molecular weight, i.e., a number average molecular weight ($\overline{M}_n$) (as determined in the same manner as described below in connection with the second component flow improver) of not greater than about 40,000, and typically ranging from about 1,500 to about 40,000, and preferably from about 2,500 to about 15,000. Corresponding specific viscosities are the same as described below in connection with the second component.

When interpolymers of monomer components depicted by formulas (I) and (II) are employed as the first component, the mole ratio employed for the polymerization of such monomers can typically vary from about 1.3:1 to about 0.5:1, preferably from about 1.2:1 to about 0.5:1, and most preferably from about 1.2:1 to about 1:1.

Furthermore, the details with respect to conditions for esterification, homopolymerization, and interpolymerization reactions are essentially the same as set forth below with reference to the esterification and interpolymerization of the dicarboxylic acid esters described below in connection with the vinyl-ester-containing interpolymers of the second component hereof.

The synergistic combinations of the present invention include, along with these specified first component carboxy ester polymers and interpolymers, at least one second component lubricating oil flow improver.

The general term "lubricating oil flow improver" (LOFI) covers all those additives which modify the size, number, and growth of wax crystals in lube oils in such a way as to impart improved low temperature handling, pumpability, and/or vehicle operability as measured by such tests as pour point and mini rotary viscometry (MRV). The majority of lubricating oil flow improvers are polymers or contain polymers. These polymers are generally of two types, either backbone or sidechain.

The backbone variety, such as the ethylenevinyl acetates (EVA), have various lengths of methylene segments randomly distributed in the backbone of the polymer which associate or cocrystallize with the wax crystals inhibiting further crystal growth due to branches and non-crystalizable segments in the polymer.

The sidechain type polymers, which are the predominant variety used as LOFI's, have methylene segments as the side chains, preferably as straight side chains. These polymers work similarly to the backbone type except the side chains have been found more effective in treating isoparaffins as well as n-paraffins found in lube oils. All the lubricating oil flow improvers of the second component of the present invention and as described hereinafter in connection with the second component fall into this latter category.

The lubricating oil flow improvers of the present invention generally comprise long chain flow improving polymers or interpolymers of the sidechain type, which contain pendent ester groups derived from a mixture of alcohols whereby the alcohol residue can be characterized as repeating methylene units, and which are oil soluble, or dispersible, polymeric compositions that generally have low molecular weights (number average, as determined by vapor phase osmometry or membrane osmometry), i.e., not greater than about 40,000, and typically in the range of between about 1,500 and 40,000, and preferably between about 2,500 and 15,000.

Alternatively, such molecular weights of the second component lubricating oil flow improvers of the present invention are more conveniently expressed by the specific viscosity exhibited by such polymers. Accordingly, such specific viscosities will typically range from about 0.11 to about 2.2, preferably from about 0.2 to about 0.9, and most preferably from about 0.2 to about 0.7.

Such specific viscosities are determined in accordance with the following equation:

$$\text{Specific Viscosity} = (\text{K-vis of Solution}/\text{K-vis of Solvent}) - 1$$

wherein "K-vis of Solution" is the kinematic viscosity at 104° F. (40° C.) of a 2.0 mass/volume percent solution of the polymer (a.i.basis) in mixed xylenes (solvent) available commercially, using Ubbelohde-type viscometers with a viscometer constant of about 0.003 cSt/second; and the "K-vis of Solvent" is the corresponding kinematic viscosity of the solvent alone at the same temperature. All specific viscosities reported herein are determined by the above method.

One class of such lubricating oil flow improvers includes interpolymers, preferably copolymers of certain unsaturated dicarboxy esters with certain specified polymerizable monomeric compounds, namely, vinyl esters, alpha-olefins, or styrene.

Suitable ethylenically unsaturated dicarboxylic acids or their anhydrides, which are eventually esterified, have the carboxyl or anhydride groups located on vicinal carbons, and have 4 to 10 carbons in the unesterified monomer molecule. Suitable dicarboxylic acids or anhydrides thus include fumaric acid, maleic anhydride, mesaconic acid, citraconic acid and anhydride, and itaconic acid and its anhydride.

The particular dicarboxylic acid or anhydride monomer which is preferred will depend on the identity of its comonomer. Thus, when the comonomer is a vinyl ester, the preferred dicarboxylic acid is fumaric acid. When the comonomer is an alpha-olefin or styrene, the preferred dicarboxylic monomer is maleic anhydride.

Furthermore, whether it is preferable to esterify the dicarboxylic acid or anhydride monomer first and then interpolymerize, or to first interpolymerize the free acid or anhydride monomer and then esterify, depends on the particular identify of the dicarboxylic monomer and its comonomer.

Thus, for example, it is conventional to first esterify the fumaric acid monomer or any other dicarboxylic monomer, prior to interpolymerization with a vinyl ester.

In contrast, it is also conventional to polymerize maleic anhydride with styrene or the alpha-olefins, and to then esterify.

The nature of the alcohols used to esterify the dicarboxylic acid or anhydride, whether prior or subsequent to interpolymerization, is the same in all instances.

Moreover, while it is preferred to achieve complete esterification of all of the carboxyl groups of the dicarboxylic monomer, it is permissible to achieve only partial esterification, of typically not less than about 70, and preferably not less than about 80, mole % of the available esterifiable carboxyl groups.

Accordingly, esterification is conducted with mixtures of alcohols, which alcohols can be slightly branched, preferably straight chain, most preferably straight chain alkyl. Thus, the alcohols used for esterification are typically selected from the $C_1$ to $C_{20}$ aliphatic alcohols, preferably the $C_6$ to $C_{20}$ aliphatic alcohols, and more preferably the $C_8$ to $C_{18}$ aliphatic alcohols. Primary alcohols are preferred over secondary and tertiary alcohols, and the alcohols are preferably saturated, although some degree of unsaturation (i.e., less than about 2 mole %) is permissible in various alcohol mixtures. Straight and lightly branched chain alcohols are preferred over highly branched alcohols.

The alcohols particularly selected for esterification should include sufficient hydrocarbon to insure oil solubility or dispersibility in the lubricating oils of the present invention, and thus mixtures of alcohols in the $C_4$ to $C_{20}$ average carbon number range are preferred, most particularly in the $C_8$ to $C_{18}$ range. In a more general sense, however, it is preferred to utilize a mixture of alcohols wherein the molar proportion, within said mixture, of alcohols containing an average carbon number between about $C_1$ and about $C_7$ can typically vary from about 0 to about 30, preferably less than about 10 mole %, based on the total number of moles of alcohols in said mixture, and correspondingly the molar portion, within said mixture, of alcohols containing an average carbon number between about $C_8$ and about $C_{18}$, can vary correspondingly from about 100 to about 70 (e.g., 100 to 75), preferably from about 100 to about 80, and most preferably from about 100 to about 90 mole % of the alcohols in said mixture. The most preferred alcohol mixtures will have an average number of carbon atoms of from 12.5 to about 13.5.

Representative examples of suitable alcohols thus include n-butanol, sec-butanol, isobutanol, n-pentanol, neopentanol, n-hexanol, octanol, isooctanol, decanol, n-dodecanol, n-tricosanol, n-tetracosanol, n-tridecanol, n-tetradecanol, n-hexadecanol, n-octadecanol, and mixtures thereof.

As indicated above, the dicarboxylic monomer can be interpolymerized with a variety of different comonomers.

The first of these comonomers is a vinyl ester defined herein, to be represented by the following formula:

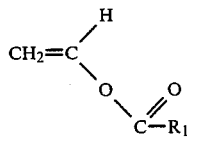

(II)

in which $R_1$ is an alkyl group containing from about 1 to 18 carbon atoms, preferably from about 1 to 6 carbon atoms, and most preferably 1 carbon atom, whereby the preferred ester monomer of formula (II) is vinyl acetate.

The preferred interpolymers of this class of lubricating oil flow improvers are $C_8$ to $C_{18}$ dialkyl fumarate/-vinyl acetate copolymers.

The mole ratio of the unsaturated dicarboxyl monomer to vinyl ester in the polymerization reaction mixture can vary typically from about 1.3:1 to 0.5:1, preferably from about 1.2:1 to 0.7:1, and most preferably from about 1.2:1 to 1:1.

Blends of two or more different dialkyl fumarate/vinyl acetate copolymers are particularly preferred as the second component wherein each component of the blend is primarily distinguished by the carbon number of the alcohols initially employed to esterify the monomers of the individual copolymers. A preferred polymer blend is comprised of an equal weight mixture of a $C_8$ to $C_{18}$ dialkyl fumarate/vinyl acetate copolymer and a $C_{12}$ to $C_{18}$ dialkyl fumarate/vinyl acetate copolymer.

These interpolymers can be prepared by conventional free radical polymerization techniques, starting with a mixture of all of the constituent monomers which is essentially free of polymer. Thus the polymers are random interpolymers and are not graft or block interpolymers. Conventional free radical polymerization catalysts, such as azobis-(isobutyronitrile), tert-butyl hydroperoxide, and benzoyl peroxide, can be used. Such polymerization techniques can be conducted neat in the absence of solvent or in bulk.

Polymerization of the ester monomers is preferably carried out in an inert hydrocarbon solvent, such as hexane or heptane, or low viscosity lubricating oils. Polymerization is carried out in an oxygen-free reactor. The desired atmosphere can be maintained by carrying out the polymerization in a nitrogen atmosphere as is known in the art. Temperatures of about 65° to about 150° C., depending on the choice of initiator, can be used. Polymerization is carried out at either atmospheric or super-atmospheric pressure and on either a batch or a continuous basis. Polymerization can be stopped when the described degree of polymerization is reached by known techniques, such as adding inhibitors to the reaction mixture, or can be allowed to go to completion.

The second component lubricating oil flow improvers of this class are distinguished from the first component in that a single $C_{14}$ alcohol is not employed to make the second component.

The second type of comonomer employed for interpolymerization with the unsaturated dicarboxyl monomer is an alpha-monoolefin. Straight chain alpha-olefins are preferred over branched chain alpha-olefins. Moreover, if branching occurs, it is preferred that it occur at the beta-carbon, and that such branching contain not more than about 5, and preferably not more than about 2, carbons. Suitable alpha-olefins typically contain between about 6 and 46, e.g., between about 10 and 22, and preferably about 18 carbon atoms per molecule. Mixtures of olefins may be used, e.g., a $C_{10}$–$C_{24}$ mixture.

Representative olefins include 1-hexane, 1-heptene, 1-nonene, 1-decene, 1-hexadecene, 1-octadecene, 1-eicosene, 1-heneicosene, 1-docosene, 1-tricontene, 1-tetracontene, 2-methyloctadecene, 2-ethyleicosene, and mixtures thereof.

The mole ratio of alpha-olefin to unsaturated dicarboxyl monomer employed in the reaction mixture will typically range from about 1.2:1 to about 0.8:1, preferably from about 1.1:1 to about 0.9:1, and most preferably about 1:1.

The preferred interpolymer of this class is an interpolymer of 1-octadecene and maleic anhydride subsequently esterified with the aforedescribed alcohols in the manner described hereinafter.

The third preferred comonomer for interpolymerization with the unsaturated dicarboxy monomer is styrene.

In forming this preferred unesterified intermediate polymer, the molar ratio of styrene to unsaturated dicarboxy-containing monomer (e.g, maleic anhydride) can typically vary from about 3:1 to about 1:1; preferably from about 2:1, to about 1:1, and most preferably from about 1.5:1 to about 1:1.

Most preferably, equal molar amounts of styrene and unsaturated carboxy containing monomer (e.g., maleic anhydride) are employed. In addition, minor amounts of other miscellaneous interpolymerizable comonomers can be included in the reaction mixture. By minor amount is typically meant less than about 1, preferably less than about 0.3 mole of miscellaneous monomers per mole of carboxy containing monomer. Similar considerations, vis-a-vis miscellaneous monomers, apply with respect to use of the alpha-olefins as a comonomer for interpolymerization with the dicarboxy monomer.

Various methods of polymerizing styrene or the alpha-olefins and the dicarboxy-containing monomers are known in the art and need not be discussed in detail herein. Such methods include neat and bulk polymerization techniques.

The polymerization reaction for use of either the styrene or alpha-olefin comonomers with the dicarboxy monomer is typically conducted to produce an unesterified interpolymer having a number average molecular weight of less than about 25,000, preferably less than about 15,000, as determined by membrane osmometry. Upon esterification, such molecular weights will be as described generally above as well as the corresponding specific viscosities.

The resulting interpolymer is then esterified with an alcohol mixture of the type described above with respect to esterification of the dicarboxy monomer.

The esterification reaction can be accomplished simply by heating the dicarboxy-containing polymer and the alcohol mixture under conditions typical for effecting esterification. Such conditions usually include, for example, a temperature of at least about 80° C., preferably from about 100° C. to about 150° C., provided that the temperature be below the decomposition point of the reaction mixture, and the water of esterification is removed as the reaction proceeds. Such conditions may optionally include the use of an excess of the alcohol reactant so as to facilitate esterification, the use of a solvent or diluent such as mineral oil, toluene, benzene, xylene or the like, and the use of an esterification catalyst such as toluene sulfonic acid, sulfuric acid, phosphoric acid, or the like. These conditions and variations thereof are well known in the art.

Another class of lubricating oil flow improvers useful in accordance with the present invention comprises the polymers and interpolymers of unsaturated mono-esters, preferably polymers of long side chain unsaturated mono-esters, and interpolymers of long and short side chain unsaturated mono-esters. The unsaturated esters are generally acrylate or 2-alkylacrylate mono-esters represented by the formula:

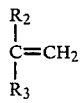

(III)

wherein $R_2$ is hydrogen or a $C_1$ to $C_5$ alkyl group; and $R_3$ is a $COOR_4$ group wherein $R_4$ is a $C_1$ to $C_{20}$, preferably a $C_{10}$ to $C_{18}$ alkyl group. A 2-alkylacrylate is one wherein $R_2$ is alkyl. The hydrocarbyl groups constituting $R_4$ represent the hydrocarbyl residues of mixtures of alcohols from which the same are prepared, which alcohols are preferably saturated, although some degree of unsaturation is permissible when mixtures of alcohols are employed, e.g., less than about 2 mole % of the alcohols in the mixture can be unsaturated. Straight chain or lightly branched alcohols are preferred over highly branched alcohols. The mixture of alcohols employed are those containing from $C_1$ to about $C_{20}$ carbons which can be employed in such proportions that the average number of carbons in the alcohol residue of the monomer molecule is preferably between about 10 and about 18. Furthermore, it is preferred that at least 60 mole %, most preferably at least 80 mole % of the alcohols present in such mixture contain between 10 and 18 carbon atoms.

Representative acrylate, and $C_1$ to $C_5$ 2-alkylacrylate monomers suitable for use in preparing the ester polymers and interpolymers of Formula (III), subject to the above carbon number average restrictions, include methyl acrylate, propyl methacrylate, propyl ethacrylate, octyl propacrylate, decyl butacrylate, dodecyl pentacrylate, hexyl methacrylate, octyl ethacrylate, decyl methacrylate, dodecyl methacrylate, tetradecyl methacrylate, hexadecyl methacrylate, octadecyl methacrylate, tridecyl acrylate, tetradecyl methacrylate, pentadecyl acrylate, hexadecyl acrylate, and octadecyl acrylate.

Most preferred acrylates or 2-alkyl acrylates are those containing $C_{12}$ to $C_{18}$ alkyl esters having a carbon number average of about 13 in the mixture for the alkyl (alcohol residue) portion of the ester.

The long chain aliphatic esters are those described in Formula (III) wherein $R_4$ may be prepared from mixed aliphatic alcohols containing from 10 to 20 carbon atoms per molecule. Saturated aliphatic alcohols containing from 12 to 18 carbon atoms per molecule are preferred.

Short chain unsaturated esters, having the above-noted Formula (III), but wherein $R_4$ has less than 10 carbons, preferably 1 to 5 carbons, in amounts of 5 to 50 molar percent, preferably 10 to 20 molar percent, based on the total polymer, can be copolymerized with the long chain unsaturated esters.

Preferably, all the alkyl esters in a given polymer will have the same acid moiety, e.g., the mixture of esters will be a mixture of acrylates or 2-alkylacrylates (e.g., methacrylates).

The minimum number of carbon atoms of the $R_4$ substituent of the ester monomer is typically selected to avoid insolubility of the polymer in the lubricating oil, and the maximum number of carbon atoms therein is selected to avoid crystallization of the polymer out of the lubricating oil at low temperatures.

The polymers or interpolymers of Formula (III) are characterized by number average molecular weights and specific viscosities as described above.

The polymers and interpolymers of Formula (III) can be prepared by conventional free radical polymerization techniques, starting with a mixture of all of the constituent monomers which is essentially free of polymer. Thus, the polymers are random interpolymers and are not graft or block interpolymers. Conventional free radical polymerization catalysts, such as azobis-(isobutyronitrile), tert butyl hydroperoxide, and benzoyl peroxide, can be used. Such polymerization techniques again include neat and bulk polymerization techniques.

Polymerization of the ester monomers is preferably carried out in an inert hydrocarbon solvent, such as hexane or heptane or low viscosity lubricating oil. Polymerization is carried out in an oxygen-free reactor. The desired atmosphere can be maintained by carrying out the polymerization in a nitrogen atmosphere as is known in the art. Temperatures of about 65° to about 120° C., depending on the choice of initiator, can be used. Polymerization is carried out at either atmospheric or super-atmospheric pressure and on either a batch or continuous basis. Polymerization can be stopped when the desired degree of polymerization is reached by known techniques, such as adding inhibitors to the reaction mixture, or can be allowed to go to completion.

As is noted above, the preferred lubricating oil compositions of the present invention include a viscosity index improver as an optional third component which is combined with the dual additive compositions in a lube oil formulation. Thus, while the dual additive composition of the present invention need not be sold in admixture with a viscosity index improver, the former will normally exert its desired effect in the presence of the latter.

These oil-soluble hydrocarbon polymeric viscosity index (V.I.) improver additives contemplated to be compounded into the lubricating oil in accordance with this invention are generally high molecular weight hydrocarbon polymers. The V.I. improvers may also be derivatized to include other properties or functions, such as the addition of dispersancy properties.

These oil soluble V.I. polymers will generally have number average molecular weights of from about 40,000 to 1,000,000, preferably from about 40,000 to about 300,000 as determined by gel permeation chromatography or membrane osmometry.

Examples of suitable hydrocarbon polymers include homopolymers and interpolymers of two or more monomers of $C_2$ to $C_{30}$, e.g., $C_2$ to $C_8$ olefins, including both alpha-olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and interpolymers of $C_6$ and higher alpha-olefins, atactic polypropylene, hydrogenated polymers and copolymers and terpolymers of styrene, e.g., with isoprene and/or butadiene.

More specifically, other hydrocarbon polymers suitable as viscosity index improvers in the present invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, alpha-olefins or lower alkenes, e.g., $C_3$ to $C_{18}$ alpha-olefins or lower alkenes. The conjugated dienes include isoprene, butadiene, 2,3-dimethylbutadiene, piperylene and/or mixtures thereof, such as isoprene and butadiene. The monovinyl aromatic compounds include any of the following, or mixtures thereof, vinyl di- or polyaromatic compounds, e.g., vinyl naphthalene, but are preferably monovinyl monoaromatic compounds, such as styrene or alkylated styrenes substituted at the alpha-carbon atoms of the styrene, such as alpha-methylstyrene, or at ring carbons, such as o-, m-, p-methylstyrene, ethylstyrene, propylstyrene, isopropyl-styrene, butylstyrene, isobutylstyrene, tert-butylstyrene (e.g., p-tert-butylstyrene). Also included are vinylxylenes, methylethyl styrenes and ethylvinylstyrenes. Alpha-olefins and lower alkenes optionally included in these random, tapered and block copolymers preferably include ethylene, propylene, butene, ethylene-propylene copolymers, isobutylene, and polymers and copolymers thereof. As is also known in the art, these random, tapered and block copolymers may include relatively small amounts, that is less than about 5 moles, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to said nucleus, the arms being comprised of homopolymer or interpolymer of said conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621; 3,318,813; 3,630,905; 3,668,125; 3,763,044; 3,795,615; 3,835,053; 3,838,049; 3,965,019; 4,358,565; and 4,557,849, the disclosures of which are herein incorporated by reference.

The polymer may be degraded in molecular weight, for example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g., an alkylene polyamine or hydroxy amine, e.g., see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489; and 4,149,984.

Suitable hydrocarbon polymers are ethylene interpolymers containing from 15 to 90 wt. % ethylene, preferably 30 to 80 wt. % of ethylene and 10 to 85 wt. %, preferably 20 to 70 wt. % of one or more $C_3$ to $C_8$, alpha-olefins. While not essential, such interpolymers preferably have a degree of crystallinity of less than 10 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexane, 1-heptene, 1-octene, etc.; also branched chain alpha-olefins, such as 4-methyl-1-pentene, 4-methyl-1-hexene, 5-methylpentene-1, 4,4-dimethyl-1-pentene, and 6-methyl-heptene-1, etc., and mixtures thereof.

Terpolymers, tetrapolymers, etc., of ethylene, said $C_{3-8}$ alpha-olefin, and a non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The lubricating oil compositions of the present invention employ a base oil which may be either natural base oil, or a mixture of natural and synthetic base oils.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the dual additive composition of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the dual additive composition of the present invention may be suitably incorporated into mixtures of natural and synthetic base oils, provided these mixtures include at least about 80% of the natural base oil. Suitable synthetic base oils for use in these mixtures include alkyl esters of dicarboxylic acids, polyglycols and alcohols; polyalpha-olefins, polybutenes, alkyl benzenes, organic esters of phosphoric acids, polysilicone oils, etc.

Natural base oils include mineral lubricating oils which may vary widely as to their crude source, e.g., whether paraffinic, naphthenic, mixed, paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends of oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cs. at 100° C.

Thus, the dual additive composition of the present invention can be employed in a lubricating oil composition which comprises lubricating oil, typically in a major amount, and the dual additive composition, typically in a minor amount, which is effective to impart the enhanced flow properties described herein. Additional conventional additives selected to meet the particular requirements of a selected type of lubricating oil composition can be included as desired.

The dual additive compositions of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the dual additive composition, for instance, is soluble or stably dispersible in oil to an extent sufficient to exert its intended effect in the environment in which the oil is employed. Moreover, the additional incorporation of other additives may also permit incorporation of higher levels of a particular dual additive composition hereof, if desired.

Accordingly, while any effective amount of the dual additive composition can be incorporated into the final, e.g., fully formulated, lubricating oil composition, it is contemplated that such effective amount be sufficient to provide said lube oil composition with an amount of the dual additive composition of typically from about 0.005 to about 0.7, e.g., 0.02 to 0.5, and preferably from 0.05 to 0.3 wt. percent, based on the weight of said lubricating composition.

With respect to the second component (i.e., lube oil flow improver), it is contemplated that effective amounts thereof in the final lubricating oil composition will typically range from about 0.003 to 0.54, e.g., from about 0.013 to 0.36, and preferably from about 0.03 to 0.033 wt. %, based on the weight of said composition.

The amount of the first component in the final lubricating oil composition is conveniently based on the amount of second component in that final composition. Accordingly, it is contemplated that effective weight ratios of the second component to the first component will typically range from about 1/0.3 to 1/0.9, preferably from about 1/0.4 to 1/0.6, and most preferably about 1/0.5. In other words, in a most preferred embodiment there will be one-half as much of the first component as the second component present in the final composition.

The optional third component, i.e., the V.I. improver, will typically be employed in the final lubricating oil composition in amounts of from about 0.6 to 2.8 wt. %, with the precise amount being selected on the basis of the particular type of lubricating oil being employed.

The dual additive composition of the present invention can be incorporated into the lubricating oil in any convenient way. Thus, it can be added directly to the oil by dispersing, or dissolving the same in the oil at the desired level of concentration. Such blending can occur at room temperature or elevated temperatures. Alternatively, the dual additive composition may be blended with a base oil to form a concentrate, and the concentrate then blended with lubricating oil base stock to obtain the final composition. Such concentrates will typically contain the dual additive composition in amounts of from about 2.0 to about 90, and preferably from about 40 to 65 percent, by weight, based on the concentrate weight. The concentrate can also include the optional third component, or V.I. improver.

The lubricating oil base stock for the dual additive composition of the present invention typically is adapted to perform a selected function by the incorporation of additives therein to form lubricating oil compositions designated as formulations.

Representative additives typically present in such formulations include corrosion inhibitors, oxidation inhibitors, friction modifiers, dispersants, anti-foaming agents, anti-wear agents, detergents, rust inhibitors and the like.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. percent of a sulfide of phosphorus for ½ to 15 hours, at a temperature in the range of 150° to 600° F. Neutralization of the phosphosulfurized hydrocarbon may be effected in the manner taught in U.S. Pat. No. 1,969,324.

Oxidation inhibitors reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N-(hydroxyalkyl)alkenyl-succinamic acids or succinimides; U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis alkanols such as described in U.S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinates, the reaction product of oil-soluble polyisobutylene succinic anhydride with ethylene amines such as tetraethylene pentamine and borated salts thereof.

Foam control can be provided by an antifoamant of the polysiloxane type, e.g., silicone oil and polydimethyl siloxane.

Anti-wear agents, as their name implies, reduce wear of metal parts. Representatives of conventional anti-wear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz, overbased) metal salts, such as highly basic alkaline earth metal sulfonates (especially Ca and Mg salts) are frequently used as detergents. Representative examples of such materials, and their methods of preparation, are found in co-pending Ser. No. 754,001, filed July 11, 1985, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | % Active Ingredient By Volume | % Active Ingredient By Weight |
|---|---|---|
| Corrosion Inhibitor | 0.01-1 | 0.01-1.5 |
| Oxidation Inhibitor | 0.01-1 | 0.01-1.5 |
| Dispersant | 0.1-7 | 0.1-8 |
| Anti-Foaming Agents | 0.001-0.1 | 0.001-0.15 |
| Anti-Wear Agents | 0.001-1 | 0.001-1.5 |
| Friction Modifiers | 0.01-1 | 0.01-1.5 |
| Detergents/Rust Inhibitors | 0.01-2.5 | 0.01-3 |
| Mineral Oil Base | Balance | Balance |

When other additives are employed, it may be desirable, although not necessary, to prepare additive concentrates comprising concentrated solutions or dispersions of the dual additive composition (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the dual additive composition and optional additional additives in proper amounts to provide the desired concentration in the final formulation when the additive-package is combined with a predetermined amount of base lubricant. Thus, the dual additive composition of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight and volume percents expressed herein are based on active ingredient (a.i.) content of the additive, and/or upon the total weight of any additive-package, or formulation which will be the sum of the a.i. weight of each additive plus the weight of total oil or diluent.

The following examples are given as specific illustrations of the claimed invention. It should be understood, however, that the invention is not limited to the specific details set forth in the examples. All parts and percentages in the examples, as well as in the remainder of the specification, are by weight unless otherwise specified.

COMPARATIVE EXAMPLE 1

A fully formulated (except for a LOFI) 15W-40 lubricating base oil (designated Base Oil A) was prepared containing mineral oil base stock oil (i.e., a mixture of 500N and 150N), V.I. improver, and a conventional detergent/inhibitor package containing ashless dispersant, anti-oxidant and anti-wear additive, and overbased sulfonate. The V.I. improver was present in Base Oil A in an amount of about 2 wt. % (a.i.) and comprised ethylene-propylene copolymer masticated to a T.E. of about 1.8±0.01, and had a weight average molecular weight of about 180,000 and a ratio of weight average molecular weight to number average molecular weight of 3.5. The copolymer had an ethylene content of 43 wt. %.

Thickening Efficiency (T.E.) is defined as the ratio of the weight percent of a polyisobutylene (sold as an oil solution by Exxon Chemical Co. as Paratone N), having a Staudinger Molecular Weight of 20,000, required to thicken a solvent-extracted neutral mineral lubricating oil, having a viscosity of 150 SUS at 37.8° C., a viscosity index of 105 and an ASTM pour point of 0° F., (Solvent 150 Neutral) to a viscosity of 12.4 centistokes at 98.9° C., to the weight percent of a test copolymer required to thicken the same oil to the same viscosity at the same temperature. T.E. is related to $M_n$ and is a convenient, useful measurement for formulation of lubricating oils of various grades.

To Base Oil A was added (in the amount shown at TABLE 2) a lube oil flow improver, designated LOFI A, comprising a 50:50 weight mixture of a two-component blend of two different dialkyl fumarate/vinyl acetate copolymers, namely Component A and Component B. For Components A and B the fumarate monomer was esterified with a mixture of alcohols having the approximate respective carbon distributions shown at TABLE 1.

TABLE 1

| CARBON DISTRIBUTION OF ALCOHOLS USED TO ESTERIFY THE FUMARATE OF: | | |
|---|---|---|
| Carbon Number | Component A Wt. % | Component B Wt. % |
| 8 | — | 12 |
| 9 | — | — |
| 10 | — | 11 |
| 11 | — | — |
| 12 | 57 | 44 |
| 13 | — | — |
| 14 | 22 | 17 |
| 15 | — | — |
| 16 | 10 | 9 |
| 17 | — | — |
| 18 | 11 | 7 |
| 19 | — | — |

The specific viscosity of the polymer blend constituting LOFI A was 0.27, and the fumarate:vinyl acetate mole ratio employed in the synthesis of both Components A and B was 1:0.8.

COMPARATIVE EXAMPLE 2

Comparative Example 1 was repeated, except that a different 15W-40 mineral oil base stock was employed. The base oil, fully formulated on accordance with Comparative Example 1 (exclusive of LOFI), was designated Base Oil B and contained the same type and amount of conventional additives as Base Oil A of Comparative Example 1. To Base Oil B was then added LOFI A, in the amount shown at TABLE 2.

COMPARATIVE EXAMPLES 3 AND 4

Comparative Examples 1 and 2 were again repeated, with the exception that LOFI A was replaced with LOFI B in the amounts shown at TABLE 2. LOFI B was a dialkyl fumarate/vinyl acetate copolymer having a specific viscosity of about 0.25 and in which the alkyl groups were derived solely from a $C_{14}$ alcohol. The vinyl acetate/fumarate mole ratio in the polymerization mixture was between 0.80 and 0.85:1. Thus, LOFI B was added to Base Oil A (Comparative Example 3), and LOFI B was added to Base Oil B (Comparative Example 4).

EXAMPLES 1 AND 2

To Base Oil A (for Example 1), and Base Oil B (for Example 2) was added a mixture of LOFI A and LOFI B in the amounts shown at TABLE 2. The resulting formulations were tested by the MRV procedure, and the results are summarized in TABLE 2.

EXAMPLES 3 AND 4

Examples 1 and 2 were repeated with the exception that LOFI A was employed in a lower amount, as is shown in TABLE 2.

The resulting formulations from Comparative Examples 1 to 4 were then also tested by the MRV procedure described below, and the results are summarized at TABLE 2.

TABLE 2

| EX. OR COMP. EX. NO. | BASE OIL | ADDITIVE TYPE* | ADDITIVE AMOUNT (WT. %) | TEST RESULTS YS (PASCALS) | TEST RESULTS VIS (PASCAL SECONDS) |
|---|---|---|---|---|---|
| Comp. Ex. 1 | A | LOFI A | 0.14 | solid | |
| Comp. | B | LOFI A | 0.14 | solid | |

TABLE 2-continued

| EX. OR COMP. EX. NO. | BASE OIL | ADDITIVE TYPE* | ADDITIVE AMOUNT (WT. %) | TEST RESULTS YS (PASCALS) | TEST RESULTS VIS (PASCAL SECONDS) |
|---|---|---|---|---|---|
| Ex. 2 | | | | | |
| Comp. Ex. 3 | A | LOFI B | 0.06 | >>500 | 320 |
| Comp. Ex. 4 | B | LOFI B | 0.06 | solid | |
| Ex. 1 | A | LOFI A + LOFI B | 0.14 0.06 | <35 | 141 |
| Ex. 2 | B | LOFI A + LOFI B | 0.14 0.06 | <35 | 131 |
| Ex. 3 | A | LOFI A + LOFI B | 0.07 0.06 | <35 | 140 |
| Ex. 4 | B | LOFI A + LOFI B | 0.07 0.06 | <35 | 147 |
| Targets for SAE 15W-40 Oil | | | | <35 | 300 MAX |

*LOFI A = $C_8$–$C_{18}$ dialkyl fumarate/vinyl acetate
LOFI B = $C_{14}$ dialkyl fumarate/vinyl acetate The analysis of the flow properties of the above-described lubricating oil compositions (both comparative and exemplary) was conducted by testing the same in a Mini Rotary Viscometer after subjecting each sample to a temperature profile controlled in accordance with ASTM D4684 over a 44-hour cooling cycle. More specifically, this test is used by the SAE (J300 Specification) for determining the low temperature pumpability of a crankcase oil. In the test procedure itself, the temperature is gradually lowered to −20° C., and then at that temperature the yield stress (YS) is measured in pascals, and the apparent viscosity (VIS) is measured in pascal seconds. The latter is required because this is a two-phase system, so that a true viscosity measurement cannot be made. Thus, in accordance with SAE requirements for 15W-40 oils, the target values of less than 35 pascals (YS) and not greater than 300 pascal seconds (VIS) are considered acceptable in order to provide a pumpable composition at −20° C., i.e., to maintain fluidity.

These results clearly demonstrate the synergistic nature of the dual additive mixtures of the present invention. The cooling cycle of the compositions including only LOFI A or LOFI B above are well below the target values, so as to adversely effect the viscosity of these compositions.

COMPARATIVE EXAMPLES 5 TO 8

In a further series of similar tests, to different samples of Base Oil B, fully formulated as in Comparative Examples 2 and 4, and using the same V.I. improver as described therein, but without any LOFI, was then added a variety of different commercial lubricating oil flow improvers, including one based on a polymethacrylate (LOFI C), one based on a polyacrylate (LOFI D) and one based on a styrene-maleic anhydride copolymer (LOFI E). A run using LOFI A as described in Comparative Example 1 was also conducted.

More particularly, LOFI C was a polyalkyl methacrylate composition having a specific viscosity of 0.43, which was derived from a mixture of alcohols approximately as is set forth in TABLE 3 below:

TABLE 3

| CARBON DISTRIBUTION | |
|---|---|
| Carbon Number | Wt. % |
| 11 | — |
| 12 | 24 |
| 13 | 22 |
| 14 | 14 |
| 15 | 12 |
| 16 | 16 |
| 17 | — |
| 18 | 8 |
| 19 | — |
| 20 | 4 |

LOFI D was a polyacrylate composition having a specific viscosity of 0.14, which was based upon a mixture of alcohols approximately as is set forth in TABLE 4 below:

TABLE 4

| CARBON DISTRIBUTION | |
|---|---|
| Carbon Number | Wt. % |
| 12 | 63 |
| 13 | — |
| 14 | 20 |
| 15 | — |
| 16 | 9 |
| 17 | — |
| 18 | 8 |

LOFI E was a styrene-maleic anhydride copolymer having a specific viscosity of 0.70 derivatized with a mixture of alcohols approximately as set forth in TABLE 5 below:

TABLE 5

| CARBON DISTRIBUTION | |
|---|---|
| Carbon Number | Wt. % |
| 12 | 51 |
| 13 | — |
| 14 | 25 |
| 15 | — |
| 16 | 14 |
| 17 | — |
| 18 | 7 |
| 19 | — |
| 20 | 3 |

The amount of each LOFI added is shown in TABLE 6. The results of MRV testing procedure are set forth in TABLE 6 below.

EXAMPLES 5 TO 8

Comparative Examples 5 to 8 were repeated, with the exception that LOFI B, as described in connection with Comparative Example 3, was also added to the Base Oil B in the amounts shown at TABLE 6. The resulting formulations were tested by the MRV procedure, and the results are summarized in Table 6.

TABLE 6

| EX. OR COMP. EX. NO. | BASE OIL | ADDITIVE TYPE* | ADDITIVE AMOUNT (WT. %) | TEST RESULTS YS (PASCALS) | TEST RESULTS VIS (PASCAL SECONDS) |
|---|---|---|---|---|---|
| Comp. Ex. 5 | B | LOFI C | 0.15 | | solid |
| Ex. 5 | B | LOFI C/ LOFI B | 0.15/ 0.06 | <35 | 145 |

TABLE 6-continued

| EX. OR COMP. EX. NO. | BASE OIL | ADDITIVE TYPE* | ADDITIVE AMOUNT (WT. %) | TEST RESULTS YS (PASCALS) | TEST RESULTS VIS (PASCAL SECONDS) |
|---|---|---|---|---|---|
| Comp. Ex. 6 | B | LOFI D | 0.15 | | solid |
| Ex. 6 | B | LOFI D/ LOFI B | 0.15/ 0.06 | <105 | 960 |
| Comp. Ex. 7 | B | LOFI E | 0.15 | | solid |
| Ex. 7 | B | LOFI E/ LOFI B | 0.15/ 0.06 | <35 | 140 |
| Comp. Ex. 8 | B | LOFI A | 0.15 | | solid |
| Ex. 8 | B | LOFI A/ LOFI B | 0.15/ 0.06 | <35 | 138 |
| Targets for SAE 15W-40 Oil | | | | <35 | 300 MAX |

*LOFI A = $C_8$-$C_{18}$ dialkyl fumarate/vinyl acetate
LOFI B = $C_{14}$ dialkyl fumarate/vinyl acetate
LOFI C = polymethacrylate
LOFI D = polyacrylate
LOFI E = esterified styrene/maleic copolymer The results further demonstrate the synergistic nature of various dual additive compositions in accordance with the present invention, that is with the first component in combination with various different lube oil flow improvers comprising the second component thereof. It will be observed that while the formulation of Example 6 did not pass the target values of this test, the dual additive combination did result in a substantial improvement in performance relative to LOFI D (Comparative Example 6) above. The use of higher amounts of the dual additive composition would be expected to result in a pass.

COMPARATIVE EXAMPLES 9-11, AND EXAMPLE 9

In order to more clearly demonstrate the criticality of the specific first component of the dual additive composition of the present invention, further tests were conducted in order to compare its use with that of compositions with other similar materials. Thus, a Base Oil C, fully formulated as described in connection with Base Oil A of Comparative Example 1, and including V.I. improver, but not including any LOFI, was prepared. To Base Oil C was added LOFI A, as described in connection with Comparative Example 1, in an amount as shown at TABLE 7 for Comparative Example 9.

In addition, several different dialkyl fumarate/vinyl acetate LOFI's were prepared which differed only in the number of carbon atoms in the dialkyl groups thereof, namely, LOFI's F through G. Thus, each different LOFI was derived from a single and different alcohol having the following number of carbon atoms:

| | Alcohol Carbon No. |
|---|---|
| LOFI F | 12 |
| LOFI G | 14 |
| LOFI H | 16 |

To different samples of Base Oil C were added LOFI A and one of LOFI's F through H, in the amounts as shown in TABLE 7.

Each of the above-described formulations was tested by the MRV procedure, and the results are summarized in TABLE 7.

TABLE 7

| EX. OR COMP. EX. NO. | BASE OIL | ADDITIVE TYPE* | ADDITIVE AMOUNT (WT. %) | TEST RESULTS YS (PASCALS) | TEST RESULTS VIS (PASCAL SECONDS) |
|---|---|---|---|---|---|
| Comp. Ex. 9 | C | LOFI A | 0.14 | >175 | solid |
| Comp. Ex. 10 | C | LOFIs A/F | 0.14/ 0.07 | >175 | solid |
| Ex. 9 | C | LOFIs A/G | 0.14/ 0.07 | <35 | 155 |
| Comp. Ex. 11 | C | LOFIs A/H | 0.14/ 0.07 | >175 | solid |
| Targets for SAE 15W-40 Oil | | | | <35 | 300 MAX |

These results further dramatically demonstrate the criticality of using the specific $C_{14}$ dialkyl fumarate/vinyl acetate first component in the dual additive composition of the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A composition capable of improving at least the low temperature flow properties of a lubricating oil composition containing a Viscosity Index Improver, comprising, as a first component at least one of (a) low molecular weight polymer of unsaturated carboxy ester having the formula:

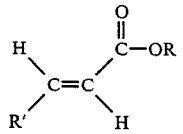

(I)

wherein R′ is selected from the group consisting of hydrogen and COOR and wherein R is a $C_{14}$ alkyl group and (b) low molecular weight copolymer of the carboxy ester of formula (I), and vinyl ester represented by the formula:

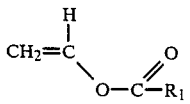

(II)

wherein $R_1$ comprises an alkyl group containing from 1 to 18 carbon atoms, and as a second component at least one lubricating oil flow improver comprising low molecular weight non-ethylene containing polymer or interpolymer containing pendent ester groups, having repeating methylene units derived from a mixture of alcohols present within the structure of said pendant ester groups; the weight ratio of said second component to said first component in said composition varying from about 1:0.3 to about 1:0.9.

2. The composition of claim 1, wherein said second component lubricating oil flow improver is at least one member selected from the group consisting of (a) polyacrylates, (b) poly-2-alkylacrylates, and (c) interpolymers comprised of esterified $C_4$ to $C_{10}$ monoethylenically unsaturated dicarboxylic acid or anhydride and a comonomer selected from the group consisting of vinyl ester, $C_6$ to $C_{46}$ alpha-olefin, and styrene.

3. The composition of claim 1 wherein said first component is a copolymer of dicarboxy ester of Formula (I), wherein R′ is COOR and vinyl ester represented by the formula:

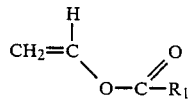

(II)

wherein $R_1$ comprises an alkyl group containing from 1 to 18 carbon atoms.

4. The composition of claim 3 wherein said vinyl ester comprises vinyl acetate.

5. The composition of claim 3 wherein said second component is polymer or interpolymer of unsaturated mono-ester represented by the formula:

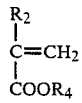

(III)

wherein, $R_2$ is hydrogen or $C_1$ to $C_5$ alkyl, and $R_4$ is $C_1$ to $C_{20}$ alkyl, with the proviso that the average number of carbon atoms in the groups constituting $R_4$ in the polymer or interpolymer is from about 10 to about 18.

6. The composition of claim 3 wherein said first component is a copolymer of $C_{14}$-dialkyl fumarate and vinyl ester, and said second component is interpolymer of dialkyl fumarate and vinyl ester, wherein the alkyl portions of said dialkyl fumarate of said second component are derived from a mixture of alcohols.

7. The composition of claim 6 wherein the alkyl portions of said dialkyl fumarate of said second component interpolymer are derived from a mixture of alcohols having an average carbon number from about 4 to about 20.

8. The composition of claim 7 wherein said average carbon number is from about 8 to about 18.

9. The composition of claim 6 wherein the mole ratio of dialkyl fumarate and vinyl ester used in preparing the interpolymers of said first and second components is from about 1.3:1 to 0.5:1.

10. The composition of any one of claims 6 to 9 wherein said vinyl ester employed for both said first and second component is vinyl acetate.

11. The composition of claim 3 wherein said second component is interpolymer comprised of (a) esterified $C_4$ to $C_{10}$ mono-ethylenically unsaturated dicarboxylic acid or anhydride, wherein the carboxy groups are located on vicinal carbons, and (b) at least one $C_6$ to $C_{46}$ alpha-monoolefin.

12. The composition of claim 11 wherein in said interpolymer of said second component, said esterified dicarboxylic acid or anhydride is derived from maleic anhydride.

13. The composition of claim 12 wherein in said interpolymer of said second component said esterified dicarboxylic anhydride is esterified with a mixture of alcohols having an average carbon number of from about 4 to about 20.

14. The composition of claim 13 wherein said average carbon number is from about 8 to about 18.

15. The composition of claim 12 wherein said alpha-olefin contains between about 10 and about 22 carbon atoms, and the mole ratio of alpha-olefin to maleic anhydride in the reaction mixture used to prepare the interpolymer of said second component is about 1.2:1 to about 0.8:1.

16. The composition of claim 11 wherein said first component is a copolymer of $C_{14}$-dialkyl fumarate and vinyl ester, and the mole ratio of said dialkyl fumarate and vinyl ester in the reaction mixture used to prepare said interpolymer is from about 1.3:1 to about 0.5:1.

17. The composition of any one of claims 11 to 16 wherein said first component is a copolymer of $C_{14}$-dialkyl fumarate and vinyl acetate.

18. The composition of claim 3 wherein said second component is interpolymer comprised of (a) esterified $C_4$ to $C_{10}$-monoethylenically unsaturated dicarboxylic acid or anhydride, wherein the carboxy groups are located on vicinal carbons and (b) styrene.

19. The composition of claim 18 wherein said second component is a styrene esterified maleic anhydride interpolymer.

20. The composition of claim 19 wherein in said interpolymer of said second component the esterified portion thereof is derived from a mixture of alcohols having an average carbon number of from about 4 to about 20.

21. The composition of claim 20 wherein said average carbon number is from about 8 to about 18.

22. The composition of claim 20 wherein the mole ratio of styrene to maleic anhydride in the reaction mixture used to prepare said second component interpolymer is from about 3:1 to about 1:1.

23. The composition of claim 18 wherein said first component is a copolymer of $C_{14}$-dialkyl fumarate and vinyl ester and the mole ratio of said dialkyl fumarate and vinyl ester in the reaction mixture used to prepare said interpolymer is from about 1.3:1 to about 0.5:1.

24. The composition of any one of claims 18 to 23 wherein said first component is a copolymer of $C_{14}$-dialkyl fumarate and vinyl acetate.

25. The composition of claim 3 wherein the number average molecular weight of said first and second components is from about 1,500 to about 40,000.

26. The composition of claim 3 in combination with a viscosity index improving amount of a viscosity index improver comprising high molecular weight hydrocarbon polymer.

27. The composition of claim 26 wherein said viscosity index improver has a number average molecular weight of between about 40,000 and 300,000.

28. The composition of claim 26 wherein said viscosity index improver comprises a compound selected from the group consisting of the polymers and interpolymers of $C_2$ to $C_{30}$ olefins.

29. The composition of claim 28 wherein said viscosity index improver comprises interpolymer of ethylene and $C_3$ to $C_{30}$ olefin.

30. The composition of claim 29 wherein said $C_3$ to $C_{30}$ olefin comprises propylene.

31. The composition of claim 26 wherein said viscosity index improver comprises a compound selected from the group consisting of the hydrogenated and partially hydrogenated homopolymers and interpolymers of conjugated dienes and/or monovinyl aromatic compounds.

32. The composition of claim 30 wherein the weight ratio of the amount of said second component to the amount of said first component in said composition ranges from about 1:0.4 to about 1:0.6.

33. A lubricating oil composition comprising lubricating oil, and a dual additive composition in an amount and additive ratio effective to improve, relative to the absence of one or more components of said dual additive composition, at least the low temperature flow properties of said lubricating oil composition when also containing a viscosity index improving amount of a viscosity index improver, said dual additive composition comprising, as a first component at least one of (a) low molecular weight polymer of unsaturated carboxy ester having the formula:

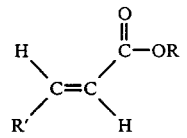

(I)

wherein R′ is selected from the group consisting of hydrogen and COOR, and wherein R is a $C_{14}$ alkyl group, and (b) low molecular weight copolymer of carboxy ester of formula (I), and vinyl ester represented by the formula:

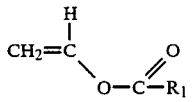

(II)

wherein $R_1$ comprises an alkyl group containing from 1 to 18 carbon atoms, and as a second component at least one lubricating oil flow improver comprising low molecular weight non-ethylene-containing polymer or interpolymer containing pendent ester groups, having repeating methylene units derived from a mixture of alcohols present within the structure of said pendant ester groups.

34. The lubricating oil composition of claim 33, wherein said second component lubricating oil flow improver is at least one member selected from the group consisting of (a) polyacrylates, (b) poly-2-alkyl acrylates, and (c) interpolymers comprised of esterified $C_4$ to $C_{10}$ mono-ethylenically unsaturated dicarboxylic acid or anhydride and comonomer selected from the group consisting of vinyl ester, $C_6$ to $C_{46}$ alpha-olefin, and styrene.

35. The lubricating oil composition of claim 34 wherein said lubricating oil has a viscosity of between about 2.5 and about 12 cs. at 100° C.

36. The lubricating oil composition of claim 34 wherein said first component is copolymer of dicarboxy ester of Formula (I) wherein R′ is COOR and vinyl ester of Formula (II).

37. The lubricating oil composition of claim 36 wherein said vinyl ester comprises vinyl acetate.

38. The lubricating oil composition of claim 34 in combination with a viscosity index improver comprising a high molecular weight hydrocarbon polymer.

39. The lubricating oil composition of claim 38 wherein said viscosity index improver has a number average molecular weight of between about 40,000 and 300,000.

40. The lubricating oil composition of claim 38 wherein said viscosity index improver comprises a compound selected from the group consisting of the polymers and interpolymers of $C_2$ to $C_{30}$ olefins.

41. The lubricating oil composition of claim 40 wherein said viscosity index improver comprises interpolymer of ethylene and $C_3$ to $C_{30}$ olefin.

42. The lubricating oil composition of claim 41 wherein said $C_3$ to $C_{30}$ olefin comprises propylene.

43. The lubricating oil composition of claim 38 wherein said viscosity index improver comprises a compound selected from the group consisting of the hydrogenated and partially hydrogenated homopolymers and interpolymers of conjugated dienes and/or monovinyl aromatic compounds.

44. The lubricating oil composition of claim 33 wherein said dual additive composition is present in an amount comprising between about 0.005 and 0.7 wt. % thereof.

45. The lubricating oil composition of claim 33 wherein said dual additive composition is present in an amount comprising between about 0.02 and 0.5 wt. % thereof.

46. The lubricating oil composition of claim 33 wherein said first and second components are present in amounts such that the weight ratio of the amount of said second component to the amount of said first component is from about 1:0.3 to about 1:0.9.

47. The lubricating oil composition of claim 46 wherein said first and second components are present in amounts such that the weight ratio of the amount of said second component to the amount of said first component is from about 1:0.4 to about 1:0.6.

48. The lubricating oil composition of claim 39 wherein said third component is present in an amount of between about 0.6 and 2.8 wt. % thereof.

49. The lubricating oil composition of claim 36 wherein said second component is a polymer or interpolymer of an unsaturated mono-ester represented by the formula:

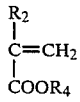

(III)

wherein $R_2$ hydrogen or $C_1$ to $C_5$ alkyl and $R_4$ is $C_1$ to $C_{20}$ alkyl, with the proviso that the average number of carbon atoms in the group constituting $R_4$ in the polymer or interpolymer is from about 10 to about 18.

50. The lubricating oil composition of claim 36 wherein said first component is a copolymer of $C_{14}$-dialkyl fumarate and vinyl ester and said second component is interpolymer of dialkyl fumarate and vinyl ester, wherein the alkyl portions of said dialkyl fumarate of said second component are derived from a mixture of alcohols.

51. The lubricating oil composition of claim 50 wherein the alkyl portions of said dialkyl fumarate of said second component interpolymer are derived from a mixture of alcohols having an average carbon number of from about 4 to about 20.

52. The lubricating oil composition of any one of claims 50 to 51 wherein said vinyl ester employed for both said first and second components is vinyl acetate.

53. The lubricating oil composition of claim 36 wherein said second component is interpolymer comprised of (a) esterified $C_4$ to $C_{10}$ mono-ethylenically unsaturated dicarboxylic acid or anhydride, wherein the carboxy groups are located on vicinal carbons, and (b) at least one $C_6$ to $C_{46}$ alpha-olefin.

54. The lubricating oil composition of claim 53 wherein in said interpolymer of said second component, said esterified dicarboxylic acid or anhydride is derived from maleic anhydride.

55. The lubricating oil composition of claim 36 wherein said first component is interpolymer of $C_{14}$-dialkyl fumarate and vinyl ester, and the mole ratio of said dialkyl fumarate and vinyl ester in the reaction mixture used to prepare said interpolymer is from about 1.3:1 to about 0.5:1.

56. The lubricating oil composition of any one of claims 53, 55 or 56 wherein said first component is interpolymer of $C_{14}$-dialkyl fumarate and vinyl acetate.

57. The lubricating oil composition of claim 36 wherein said second component is interpolymer comprised of (a) esterified $C_4$ to $C_{10}$ mono-ethylenically unsaturated dicarboxylic acid or anhydride, wherein the carboxy groups are located on vinical carbons and (b) styrene.

58. The lubricating oil composition of claim 57 wherein said second component is a styrene esterified maleic anhydride interpolymer.

59. The lubricating oil composition of claim 57 wherein said first component is interpolymer of $C_{14}$-dialkyl fumarate and vinyl ester and the mole ratio of said dialkyl fumarate and vinyl ester in the reaction mixture used to prepare said interpolymer is from about 1.3:1 to 0.5:1.

60. The lubricating oil composition of any one of claims 57, 59 or 60 wherein said first component is interpolymer of $C_{14}$-dialkyl fumarate and vinyl acetate.

61. A lubricating oil concentrate comprising lubricating oil, and a dual additive composition in an amount effective to improve, relative to the absence of either of said dual additive composition components, at least the low temperature flow properties of lubricating oil compositions derived from said concentrates, when containing viscosity index improver, said additive composition comprising as a first component, at least one of (a) low molecular weight polymer of unsaturated carboxy ester having the formula:

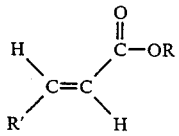

(I)

wherein R′ is selected from the group consisting of hydrogen and COOR, and wherein R is a $C_{14}$ alkyl group, and (b) low molecular weight copolymer of carboxy ester of formula (I), and vinyl ester represented by the formula:

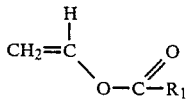

(II)

wherein $R_1$ comprises an alkyl group containing from 1 to 18 carbon atoms, and as a second component at least one lubricating oil flow improver comprising low molecular weight non-ethylene-containing polymer or interpolymer containing pendent ester groups, having repeating methylene units derived from a mixture of alcohols present in said pendant ester groups.

62. The lubricating oil concentrate of claim 61 wherein said dual additive composition comprises from about 2 to about 90 wt. % of said lubricating oil. concentrate.

63. The lubricating oil concentrate of claim 62, wherein said second component lubricating oil flow improver is at least one member selected from the group consisting of (a) polyacrylates, (b) poly-2-alkyl acrylates, and (c) interpolymers comprised of esterified $C_4$ to $C_{10}$ mono-ethylenically unsaturated dicarboxylic acid or anhydride and comonomer selected from the group consisting of vinyl ester, $C_6$ to $C_{46}$ alpha-olefin, and styrene.

64. The lubricating oil concentrate of claim 63 wherein said first component is a copolymer of dicarboxy ester of Formula (I) wherein R′ is COOR and vinyl ester represented by the formula:

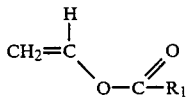

(II)

wherein $R_1$ comprises an alkyl group containing from 1 to 18 carbon atoms.

65. The lubricating oil concentrate of claim 64 wherein said vinyl ester comprises vinyl acetate.

66. The lubricating oil concentrate of claim 63 in combination with a viscosity index improving amount of viscosity index improver comprising high molecular weight hydrocarbon polymer.

67. The lubricating oil concentrate of claim 64 wherein said second component is a polymer or interpolymer of an unsaturated mono-ester represented by the formula:

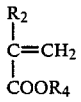

(III)

wherein $R_2$ is hydrogen or $C_1$ to $C_5$ alkyl and $R_4$ is $C_1$ to $C_{20}$ alkyl, with the proviso that the average number of carbon atoms in the group constituting $R_4$ in the polymer or interpolymer is from about 10 to about 18.

68. The lubricating oil concentrate of claim 64 wherein said first component is copolymer of $C_{14}$-dialkyl fumarate and vinyl ester and said second component is interpolymer of dialkyl fumarate and vinyl ester, wherein the alkyl portions of said dialkyl fumarate of said second component are derived from a mixture of alcohols.

69. The lubricating oil concentrate of claim 68 wherein the alkyl portions of said dialkyl fumarate of said second component interpolymer are derived from a mixture of alcohols having an average carbon number of from about 4 to about 20.

70. The lubricating oil concentrate of any one of claims 68 to 70 wherein said vinyl ester employed for both said first and second components is vinyl acetate.

71. The lubricating oil concentrate of claim 64 wherein said second component is interpolymer of (a) esterified $C_4$ to $C_{10}$ mono-ethylenically unsaturated dicarboxylic acid or anhydride, wherein the carboxy groups are located on vicinal carbons, and (b) $C_6$ to $C_{46}$ alpha-olefin.

72. The lubricating oil concentrate of claim 64 wherein said second component is interpolymer of (a) esterified $C_4$ to $C_{10}$ mono-ethylenically unsaturated dicarboxylic acid or anhydride, wherein the carboxy groups are located on vicinal carbons and (b) styrene.

73. The lubricating oil concentrate of claim 72 wherein said first component is a copolymer of $C_{14}$-dialkyl fumarate and vinyl ester and the mole ratio of said dialkyl fumarate and vinyl ester in the reaction mixture used to prepare said interpolymer is from about 1.3:1 to 0.5:1.

74. The lubricating oil concentrate of any one of claims 72 or 73 wherein said first component is a copolymer of $C_{14}$-dialkyl fumarate and vinyl acetate.

75. A method for improving at least the low temperature flow properties of a lubricating oil composition when containing a viscosity index improving amount of a viscosity index improver, which comprises adding to said lubricating oil composition a dual additive composition comprising as a first component at least one of (a) low molecular weight polymer of unsaturated carboxy ester having the formula:

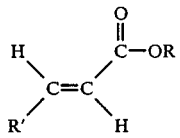

(I)

wherein R selected from the group consisting of hydrogen and COOR, and wherein R′ is a $C_{14}$ alkyl group and (b) low molecular weight copolymer of carboxy ester of formula (I), and, vinyl ester represented by the formula:

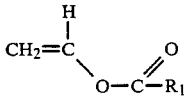

(II)

wherein $R_1$ comprises an alkyl group containing from 1 to 18 carbon atoms, and as a second component at least one lubricating oil flow improver comprising low molecular weight non-ethylene-containing polymer or interpolymer containing pendent ester groups, having repeating methylene units derived from a mixture of alcohols present within the structure of said pendant ester groups; the amount and additive ratio of said first and second components being effective to improve the low temperature flow properties of said lubricating oil composition relative to the absence of either of said first and second components.

76. The method of claim 75 wherein said second component lubricating oil flow improver is selected from at least one member selected from the group consisting of (a) polyacrylates, (b) poly-2-alkyl acrylates, and (c) interpolymers comprised of esterified $C_4$ to $C_{10}$ monoethylenically unsaturated dicarboxylic acid or anhydride and comonomer selected from the group consisting of vinyl ester, $C_4$ to $C_{46}$ alpha-monoolefin, and styrene.

77. The method of claim 76 including incorporating said dual additive composition into a lubricating oil composition containing a viscosity index improver comprising high molecular weight hydrocarbon polymer.

78. The method of claim 77 wherein said viscosity index improver has a number average molecular weight of between about 40,000 and 300,000.

79. The method of claim 75 wherein said first component is a copolymer of dicarboxy ester of Formula (I) wherein R′ is COOR and vinyl ester represented by the formula:

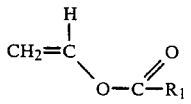

(II)

wherein $R_1$ comprises an alkyl group containing from 1 to 18 carbon atoms.

80. The method of claim 79 wherein said vinyl ester comprises vinyl acetate.

81. The method of claim 75 wherein said dual additive composition is included in said lubricating oil composition in an amount comprising between about 0.005 and 0.7 wt. % thereof.

82. The method of claim 75 wherein said dual additive composition is included in said lubricating oil composition in an amount comprising between about 0.02 and 0.5 wt. % thereof.

83. The method of claim 75 wherein said first and second components are present in amounts such that the weight ratio of the amount of said second component to the amount of said first component is from about 1:0.3 to about 1:0.9.

84. The method of claim 83 wherein said first and second components are present in amounts such that the weight ratio of the amount of said second component to the amount of said first component is from about 1:0.4 to about 1:0.6.

* * * * *